US008715053B2

(12) United States Patent
Kelly et al.

(10) Patent No.: US 8,715,053 B2
(45) Date of Patent: May 6, 2014

(54) CLOCK HAND BONUS GAME

(75) Inventors: Bryan Kelly, Alamo, CA (US); Bruce Rowe, Henderson, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 863 days.

(21) Appl. No.: 12/163,994

(22) Filed: Jun. 27, 2008

(65) Prior Publication Data

US 2009/0325662 A1 Dec. 31, 2009

(51) Int. Cl.
*A63F 9/24* (2006.01)

(52) U.S. Cl.
USPC ..... 463/16; 463/17; 463/18; 463/20

(58) Field of Classification Search
USPC ..... 463/20, 16, 17, 18
See application file for complete search history.

(56) References Cited

U.S. PATENT DOCUMENTS

| | | | | |
|---|---|---|---|---|
| 2,799,500 | A * | 7/1957 | Zekowski | 273/454 |
| 4,948,133 | A * | 8/1990 | Helm et al. | 273/124 A |
| 5,584,763 | A * | 12/1996 | Kelly et al. | 463/16 |
| 6,537,150 | B1 | 3/2003 | Luciano et al. | |
| 6,905,407 | B2 * | 6/2005 | Nordman | 463/20 |
| 7,086,950 | B2 * | 8/2006 | Gordon et al. | 463/42 |
| 7,338,370 | B2 * | 3/2008 | Oles et al. | 463/25 |
| 7,857,698 | B2 * | 12/2010 | Hein et al. | 463/25 |
| 8,021,223 | B2 * | 9/2011 | Rose | 463/16 |
| 2002/0042296 | A1 * | 4/2002 | Walker et al. | 463/23 |
| 2003/0100361 | A1 * | 5/2003 | Sharpless et al. | 463/25 |
| 2004/0033831 | A1 * | 2/2004 | Tarantino | 463/22 |
| 2004/0043811 | A1 * | 3/2004 | Seelig et al. | 463/16 |
| 2004/0102238 | A1 * | 5/2004 | Taylor | 463/16 |
| 2004/0137979 | A1 * | 7/2004 | Rose | 463/16 |
| 2004/0185928 | A1 * | 9/2004 | Baerlocher et al. | 463/16 |
| 2005/0014547 | A1 * | 1/2005 | Gomez et al. | 463/16 |
| 2005/0037835 | A1 * | 2/2005 | Nordman | 463/20 |
| 2005/0070353 | A1 * | 3/2005 | Webb et al. | 463/16 |
| 2006/0160620 | A1 * | 7/2006 | Matthews et al. | 463/42 |
| 2006/0249897 | A1 | 11/2006 | Jubinville et al. | |
| 2007/0060273 | A1 * | 3/2007 | Webb et al. | 463/16 |
| 2007/0155481 | A1 * | 7/2007 | Vancura | 463/22 |
| 2007/0197301 | A1 * | 8/2007 | Cole | 463/46 |
| 2007/0232378 | A1 * | 10/2007 | Gomez et al. | 463/16 |
| 2007/0287530 | A1 * | 12/2007 | Seelig et al. | 463/20 |
| 2007/0293301 | A1 * | 12/2007 | Seelig et al. | 463/20 |
| 2008/0182638 | A1 | 7/2008 | Paulsen et al. | |
| 2009/0124326 | A1 * | 5/2009 | Caputo et al. | 463/20 |
| 2009/0227357 | A1 * | 9/2009 | Rasmussen | 463/21 |
| 2009/0275400 | A1 | 11/2009 | Rehm et al. | |
| 2011/0059788 | A1 | 3/2011 | Itagaki et al. | |

OTHER PUBLICATIONS

Balestra, Mark, "Macau Considers I-Gaming Regulation", Feb. 27, 2007, downloaded by USPTO on Jul. 12, 2013 from http://www.casinocitytimes.com/article/macau-considers-i-gaming-regulation-52452, pp. 2-3.*

* cited by examiner

*Primary Examiner* — Pierre E Elisca
(74) *Attorney, Agent, or Firm* — Paul Hickman; Marvin Hein

(57) ABSTRACT

In various embodiments, a clock hand bonus game is provided. Moreover, in various embodiments, a system, method and apparatus is provided for a bonus gaming machine. The bonus gaming machine operates with a face and two clock hands which rotate about the face. The bonus gaming machine operates in conjunction with a base gaming apparatus. The face displays a set of indicia which the two clock hands may point to as indication of a prize. The prize may be awarded in conjunction with a prize of the base gaming machine or independently.

20 Claims, 8 Drawing Sheets

CLOCK HAND BONUS GAME

INCORPORATION BY REFERENCE

U.S. Pat. No. 5,584,763 is hereby incorporated by reference herein in its entirety.

BACKGROUND

Various types of gaming machines have been developed with different features to captivate and maintain player interest. In general, a gaming machine allows a player to play a game in exchange for a wager. Depending on the outcome of the game, the player may be entitled to an award which is paid to the player by the gaming machine, normally in the form of currency or game credits. Gaming machines may include flashing displays, lighted displays or sound effects to capture a player's interest in a gaming device.

Another important feature of maintaining player interest in a gaming machine includes providing the player with many opportunities to win awards such as cash or prizes. For example, in some slot machines, the display windows show more than one adjacent symbol on each reel, thereby allowing for multiple-line betting. Some gaming machines offer a player an opportunity to win millions large prizes by providing progressive jackpots. Additionally, feature games of various types have been employed to reward players above the amounts typically awarded on a standard game pay schedule. Generally, such feature games are triggered by predetermined events such as one or more appearances of certain combinations of indicia in a primary game. In order to simulate interest, feature games are typically set to occur at a gaming machine on a statistical cycle based upon the number of primary game plays.

While gaming machines, including feature games, have been very successful, there remains a need for games that provide a player with enhanced excitement and increased opportunity of winning. Over time, the opportunity to win tends to be more important to most players than flashing displays, lighted displays or sound effects. However, an increase in the opportunity to win (or a perceived increase) may be coupled with other options for maintaining a player's interest.

The foregoing examples of the related art and limitations related therewith are intended to be illustrative and not exclusive. Other limitations of the related art will become apparent to those of skill in the art upon a reading of the specification and a study of the drawings. Additionally, limitations and disadvantages of the related art may become apparent from review of other related art itself.

SUMMARY

In various embodiments, a system, method and apparatus is provided for a bonus gaming machine. The bonus gaming machine operates with a face and two clock hands which rotate about the face. The bonus gaming machine operates in conjunction with a base gaming apparatus. The face displays a set of indicia which the two clock hands may point to in indication of a prize. The prize may be awarded in conjunction with a prize of the base gaming machine or independently.

In an embodiment, a gaming apparatus is provided. The gaming apparatus includes a first clock hand and a second clock hand. The gaming apparatus also includes a face. The face has a generally planar surface. The face further has indicia arranged in a generally circular pattern on a first surface of the face. The first clock hand is arranged to rotate about the first surface of the face and the second clock hand is arranged to rotate about the first surface of the face. The gaming apparatus also includes an interface. The interface is to couple to a base game apparatus.

The gaming apparatus also includes a controller. The controller is coupled to the first clock hand and the second clock hand and to the interface. The controller is to rotate the first clock hand and the second clock hand. The controller is to operate the first clock hand and the second clock hand in relation to signals received through the interface. The gaming apparatus is to produce a gaming result based on indicia of the face in relation to the first clock hand and the second clock hand.

In another embodiment, a system is provided. The system includes a base game apparatus. The system also includes a bonus game apparatus coupled to the base game apparatus. The bonus game apparatus is to receive a signal from the base game apparatus. The bonus game apparatus includes a first clock hand and a second clock hand. The bonus game apparatus also includes a face. The face has a generally planar surface and indicia arranged in a generally circular pattern on a first surface of the face. The first clock hand is arranged to rotate about the first surface of the face and the second clock hand is also arranged to rotate about the first surface of the face. The bonus game apparatus further includes an interface. The interface is to couple to the base game apparatus. The bonus game apparatus also includes a controller which is coupled to the first clock hand and the second clock hand and to the interface. The controller is to rotate the first clock hand and the second clock hand. The controller is to operate the first clock hand and the second clock hand in relation to a signal received through the interface. The bonus gaming apparatus is to produce a gaming result based on indicia of the face in relation to the first clock hand and the second clock hand.

In an embodiment, system further includes a housing. The housing surrounds the base game apparatus and the bonus game apparatus. The system also includes a network interface. The network interface is to communicate with a network external to the system.

In yet another embodiment, a method is provided. The method includes receiving a signal from an associated base game. The method also includes spinning a first clock hand around a set of indicia of a bonus game. The set of indicia are presented on a first surface of a face. The method also includes spinning a second clock hand of the bonus game around the set of indicia. The method further includes stopping the first clock hand at a first indicia of the set of indicia. The method also includes stopping the second clock hand at a second indicia of the set of indicia. Moreover the method includes calculating a gaming result based on the first indicia and the second indicia. Additionally, the method includes displaying the gaming result on the bonus game.

In another embodiment, a gaming apparatus is provided. The gaming apparatus includes a first clock hand and a second clock hand. The gaming apparatus further includes a face. The face has a generally planar surface and has indicia arranged in a generally circular pattern on a first surface of the face. The first clock hand is arranged to rotate about the first surface of the face and the second clock hand is also arranged to rotate about the first surface of the face. The indicia of the first surface of the face include a first set of indicia arranged in an outer circle having a generally circular pattern. The first clock hand is arranged to point to indicia of the first set of indicia. The indicia of the first surface of the face include a second set of indicia arranged in an inner circle having a generally circular pattern. The second clock hand is arranged to point to indicia of the second set of indicia.

The gaming apparatus also includes an interface. The interface is to couple to a base game apparatus. The gaming apparatus further includes a controller. The controller is coupled to the first clock hand and the second clock hand and to the interface. The controller is to rotate the first clock hand and the second clock hand. The controller is to operate the first clock hand and the second clock hand in relation to signals received through the interface. The gaming apparatus also includes a result display coupled to the controller to receive and display a gaming result from the controller. The gaming apparatus is to produce the gaming result based on the first and second indicia of the face in relation to the first clock hand and the second clock hand.

In yet another embodiment, a gaming apparatus is provided. The gaming apparatus includes means for displaying a set of potential results. The set of potential results is displayed in a generally circular pattern on a first surface of the means for displaying. The gaming apparatus also includes means for indicating a first result of the set of potential results. The gaming apparatus further includes means for indicating a second result of the set of potential results. The gaming apparatus includes means for controlling the means for indicating the first result and the means for indicating the second result. The means for controlling is further for generating a gaming result based on the first result and the second result. The means for controlling operates responsive to a signal from a base game apparatus. The gaming apparatus also includes means for communicating with the base game apparatus.

In another embodiment, a system is provided. The system includes a base game apparatus. The system also includes a bonus game apparatus coupled to the base game apparatus. The bonus game apparatus is to receive a signal from the base game apparatus. The bonus game apparatus includes a first clock hand and a second clock hand. The bonus game apparatus also includes a face. The face has a generally planar surface and indicia arranged in a generally circular pattern on a first surface of the face. The first clock hand is arranged to rotate about the first surface of the face and the second clock hand is also arranged to rotate about the first surface of the face. The bonus game apparatus further includes an interface. The interface is to couple to the base game apparatus. The bonus game apparatus also includes a controller which is coupled to the first clock hand and the second clock hand and to the interface. The controller is to rotate the first clock hand and the second clock hand. The controller is to operate the first clock hand and the second clock hand in relation to a signal received through the interface. The bonus game apparatus is to produce a gaming result based on indicia of the face in relation to the first clock hand and the second clock hand.

In still another embodiment, a system is provided. The system includes means for playing a base game. The system further includes means for displaying a set of potential results. The set of potential results is displayed in a generally circular pattern on a first surface of the means for displaying. The system also includes means for indicating a first result of the set of potential results. The system further includes means for indicating a second result of the set of potential results. The system includes means for controlling the means for indicating the first result and the means for indicating the second result. The means for controlling is further for generating a gaming result based on the first result and the second result. The means for controlling operates responsive to a signal from a base game apparatus. The system also includes means for communicating with the means for playing a base game.

In another embodiment, a method is provided. The method includes playing an associated base game of a plurality of associated base games. The method also includes producing a base gaming result in the associated base game. The method further includes sending a signal from the associated base game based on the base gaming result. Additionally, the method includes receiving the signal from the associated base game. Furthermore, the method includes spinning a first clock hand around a set of indicia of a bonus game, the set of indicia presented on a first surface of a face. Moreover, the method includes spinning a second clock hand of the bonus game around the set of indicia. The method includes stopping the first clock hand at a first indicia of the set of indicia and stopping the second clock hand at a second indicia of the set of indicia. Additionally, the method includes calculating a gaming result based on the first indicia and the second indicia. Also, the method includes displaying the gaming result on the bonus game.

In yet another embodiment, a method is provided. The method includes playing an associated base game. The method also includes producing a base gaming result in the associated base game. The method further includes sending a signal from the associated base game based on the base gaming result. Also, the method includes receiving the signal from the associated base game in a bonus game. Moreover, the method includes spinning a first clock hand around a first set of indicia of the bonus game. The first set of indicia is presented on a first surface of a face of the bonus game. Likewise, the method includes spinning a second clock hand of the bonus game around a second set of indicia of the bonus game. The second set of indicia is presented on the first surface of the face of the bonus game. Also, the method includes stopping the first clock hand at a primary indicia of the first set of indicia. Likewise, the method includes stopping the second clock hand at a secondary indicia of the second set of indicia. Moreover, the method includes calculating a gaming result based on the primary indicia and the secondary indicia. Furthermore, the method includes displaying the gaming result on the bonus game.

BRIEF DESCRIPTION OF THE DRAWINGS

The present invention is illustrated by way of example in the accompanying drawings. The drawings should be understood as illustrative rather than limiting.

The drawings should be understood as illustrative rather than limiting.

DETAILED DESCRIPTION

A system, method and apparatus is provided for a clock hand bonus game. The specific embodiments described in this document represent example embodiments of the present invention, and are illustrative in nature rather than restrictive.

In the following description, for purposes of explanation, numerous specific details are set forth in order to provide a thorough understanding of the invention. It will be apparent, however, to one skilled in the art that the invention can be practiced without these specific details. In other instances, structures and devices are shown in block diagram form in order to avoid obscuring the invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments.

In some embodiments, this bonus game feature may be a top box bonus game or round for a casino gaming device. Sample names may include "Bonus Time" or "Fortune Time" among other names. In some embodiments, the primary game triggers the bonus game and both hands would spin. The first hand would stop and show the prize value. This value would be shown on a win meter to the player. The second smaller clock hand would continue to spin throughout. Shortly thereafter the small hand would stop spinning and its point would point to a value that has a multiplier value. The prize value would then be multiplied by the multiplier value to determine a total award. Alternatively, the values may be additive, for example.

The visual tease of the two step sequence is potentially compelling. A player may know his prize award (small, medium, or large) but still wouldn't know if the final award was going to be good or not. Only after the second hand stops do they fully see the total value of the prize award. Similarly, a result such as a bankrupt or zero value may not be immediately apparent, resulting in continuing suspense.

Figure 1:
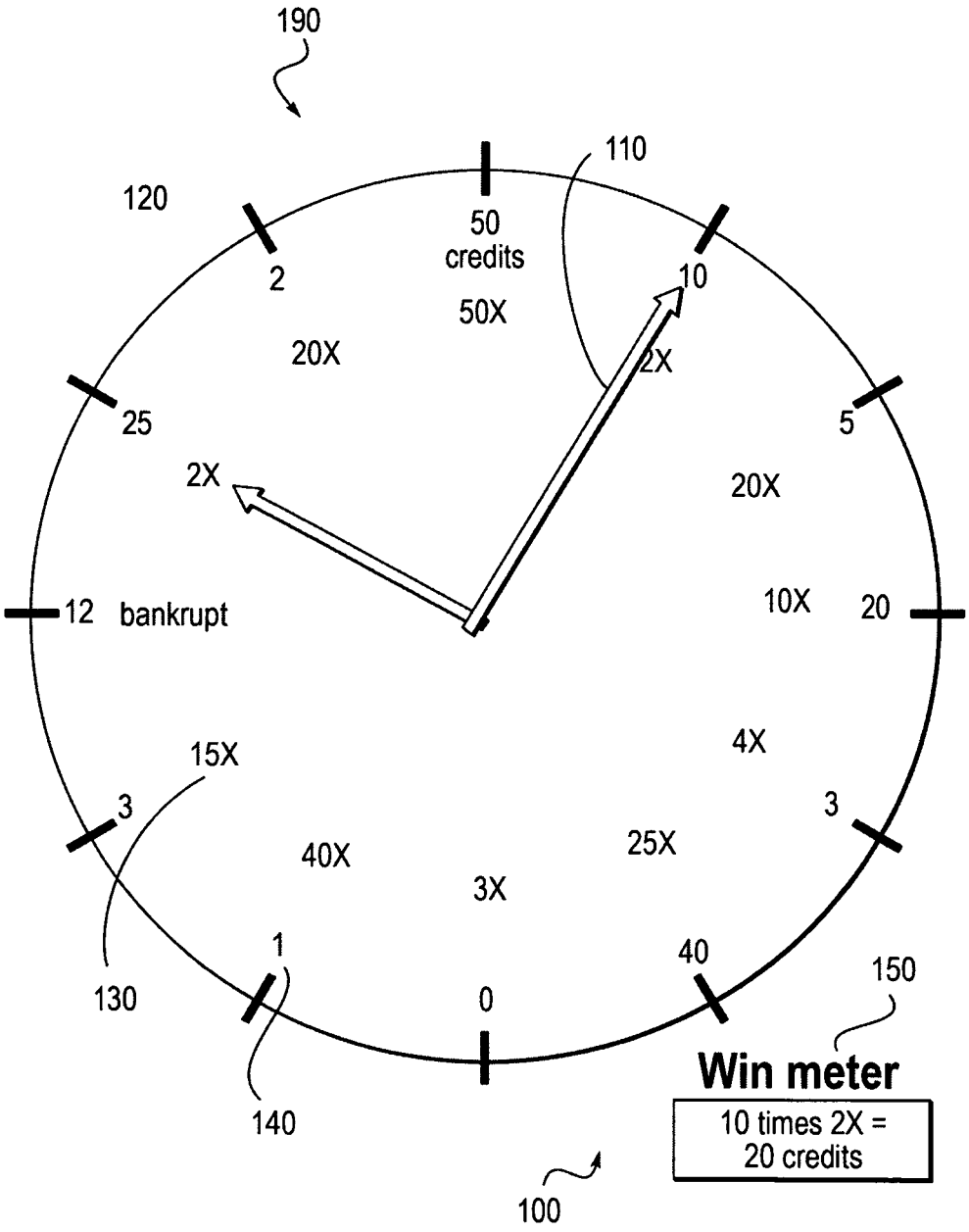
FIG. 1 illustrates an embodiment of a clock hand bonus apparatus.

Turning to a specific embodiment, FIG. 1 illustrates an embodiment of a clock hand bonus apparatus. Game 100 is provided with a face on which appear two concentric circles of indicia (prize indications) and about which two clock hands rotate. Game 100 also is provided with a display of a gaming result. Face 190 is a generally planar and circular surface which provides a background for game 100. Face 190 has displayed on it (or around it) indicia—in this embodiment two sets of indicia arranged in a generally circular pattern. First set of indicia 140 provides an outer circle of indicia which may be pointed to by first clock hand 110. Second set of indicia 130 provides an inner circle of indicia which may be pointed to by second clock hand 120. Win meter 150 provides an indication of a gaming result—in this embodiment the product of the specific indicia pointed to by each of clock hands 110 and 120.

In general, this embodiment operates by spinning the two clock hands about a central axis and having the clock hands stop at selected indicia on the face. The hands may be caused to spin using one or more motors M, either directly or through a drive mechanism, as will be appreciated by those skilled in the art. (An example of a drive mechanism may be found in U.S. Pat. No. 5,584,763 at FIGS. 2-5 and accompany text, which is hereby incorporated herein by reference.) The gaming result from this process is a product of the indicia pointed to by the two clock hands. This gaming result may then be used as a standalone result, a combined result (with another game) or a progressive result (a combination with multiple games). The gaming result itself may be referred to as a bonus gaming result in situations where the embodiment is used as a bonus game associated with a base game or a plurality of base games.

Figure 2:
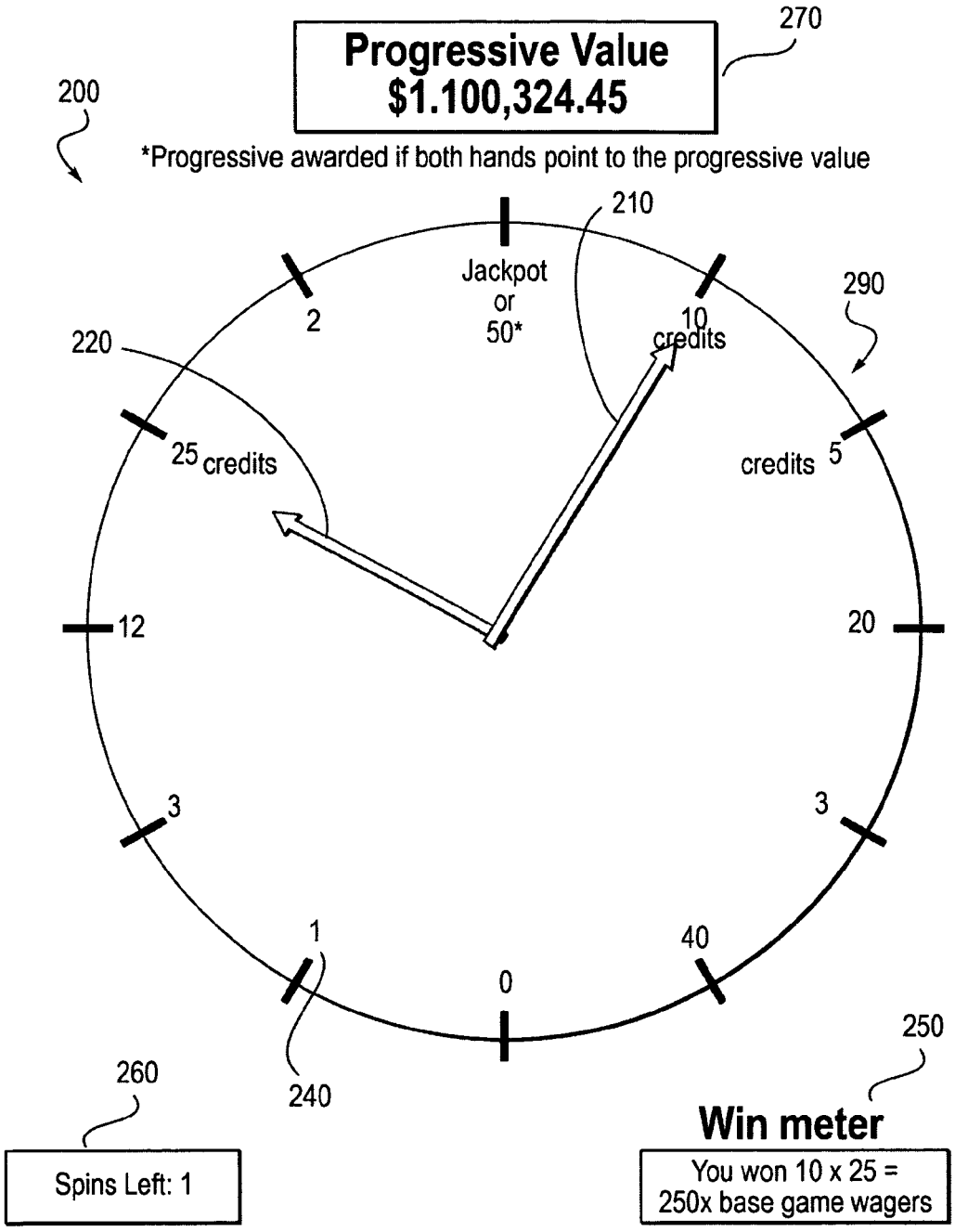
FIG. 2 illustrates another embodiment of a clock hand bonus apparatus.

FIG. 2 illustrates another embodiment of a clock hand bonus apparatus. Game 200 is provided with a face on which appears a generally circular arrangement of indicia (prize indications) and about which two clock hands rotate. Game 200 also is provided with a display of a gaming result, a display of a progressive prize value and a display of a number of spins left. Face 290 is a generally planar and circular surface which provides a background for game 200. Face 290 has displayed on it (or around it) indicia—in this embodiment a single set of indicia arranged in a generally circular pattern. Set of indicia 240 provides a circle of indicia which may be pointed to by first clock hand 210 and by second clock hand 220. Win meter 250 provides an indication of a gaming result—in this embodiment the product of the specific indicia pointed to by each of clock hands 210 and 220. Spins left meter 260 provides an indication of the number of spins left for the player to use—allowing for games where a player can spin multiple times. Progressive prize meter 270 provides an indication of a progressive prize value.

In general, this embodiment can be operated in the same way as the embodiment of FIG. 1. Additionally, the spins left meter provides the opportunity to allow multiple spins. Multiple spins may be implemented to allow one to choose the best spin, the last spin, or a combination of multiple spins as a prize or bonus prize. Multiple spins may also increase the opportunity for a bonus to be taken away with a bankruptcy or zero prize, too. In the embodiment illustrated, the progressive prize is awarded only if both hands point to the progressive prize indicia. For an embodiment with two sets of indicia, the two hands may need to point to progressive prize indicia for each hand instead. Moreover, each of the indicia may be thought of as a potential result, and the clock hands may be thought as pointing to the actual results.

Additional considerations may be taken into account in various embodiments. For example, inner and outer clock hands pointing to different number systems (one being award value and one being the multiplier value) may be used. Alternatively, the hands can point to the same number system and these numbers multiply or add together to determine a total prize value.

The multiplier value and the award value can be on the inside or outside in various embodiments (long or short hand would point to one and the other hand would point to the other). A bankrupt symbol—a 0× multiplier or 0 prize value would give a zero bonus game score in some embodiments. Alternately it could give a free re-spin of 1 or both clock hands in other embodiments. A prize value may be a jackpot value and may trigger the award of a progressive jackpot in some embodiments. The multiplier hand may multiply this value in yet other embodiments.

Certain positions on the clock may not award prize value but a quantity of re-spins on the primary base game or on the bonus game itself (e.g. more credits or spins may be awarded). Alternately the outcome of all spins on the clock bonus time game may determine a number of "free" or additional spins on the base or primary game.

In some embodiments, the numbers (the indicia) surrounding the clock may be digital displays and may change between spins. Other symbols may be used, particularly for a bankrupt or jackpot result. In some embodiments there can be "Lose a Spin" on the reels—this results in decrementing the spins left counter. Similarly, some multipliers may be negative in value, as may be the prize value. Such results then take away from the win meter from previous clock hand spins. This creates an up and down tease in multiple spin bonus rounds.

Prizes can be awarded directly to a player account or to the base game credit meter in various embodiments. Prize awards may be a fixed number of credits, cash points or can be a multiple of the base game credits wagered in various implementations. In some embodiments or some settings, the bonus time game may not ever trigger if there are not enough credits wagered on the primary game. Any one of the prize values may award a progressive number. The progressive prize value may be on a separate overhead LCD display over a bank of games or internal to a group or single game.

The game may be played on the iVIEW system available from Bally as a Live Rewards Bonus game. The advancement to earning the bonus game is determined by the base game wagers. A certain percentage of the wagers would accrue to a casino patrons PlayPoint account (available from Bally). When the person has enough playpoints they may earn this bonus game or another bonus game of their choice viewable on iVIEW or on any monitor. Winnings are added to the player account and can be club points, cash, restricted cash or other forms of winnings. Note that other interactive game systems may also be used, and other player tracking systems may be used in various embodiments, aside from iVIEW and PlayPoints.

Additionally, the game may be played in some embodiments using a spin button or instant spin feature (such as the "Spin" button available on some Bally games). This may allow the game to be initiated or terminated (or both) by the spin button or feature (spin button), for example. Other embodiments may involve the spin button terminating the game through a deceleration of a clock hand or the clock hands in response to activation of the spin button. Furthermore, deceleration of one or both clock hands may be used regardless of whether a spin button or similar feature is used, as the visual tease element may be incorporated into the game without need for the spin button control. Note that deceleration in this instance refers to deceleration that is visually perceptible to a human observer—it would serve the purpose of creating excitement and entertainment. Inherent deceleration of a moving object (either an actual object or a video image of an object) to a stop may occur at a rate that is impossible to observe, and that would not create the visual tease aspect of a slowing clock hand. This may involve, for example, the first hand stopping completely before the second hand decelerates to a stop, or other combinations of operation (e.g. both hands decelerating near simultaneously). In some embodiments, multiple spins of one or both of the clock hands can contribute to a bonus as well.

In some embodiments, the game may be played with a motion similar to a clock—having the larger or longer clock hand move around once and the smaller clock hand then move a smaller portion of the wheel. This may be used to achieve a progressive bonus, where the clock hands indicate an increasing bonus amount, for example. In another alternative, the clock hands may be used for purposes of matching location—a prize may be awarded based on having the large and small clock hands overlaid, or matching. Similarly, a prize may be awarded when the large clock hand points in a direction diametrically opposed to the small clock hand. Such clock hand motion may be part of a game, and controlled by a control such as a spin button, or it may be predetermined with the clock hands merely displaying a result from an associated game.

Note that in some embodiments, the result of the clock hands operation may modify the base game, such as providing a bonus back to the base game or providing a signal (e.g. a message) to the base game that the base game can use to enable options for play. Thus, the clock hand bonus need not be maintained separately in all embodiments. Additionally, in some embodiments, the clock hand bonus can be handled through a combination of a separate clock hand bonus maintained by the clock hand bonus system or game, and through modification of the base game, such as through a bonus or message sent back to the base game.

Figure 3:
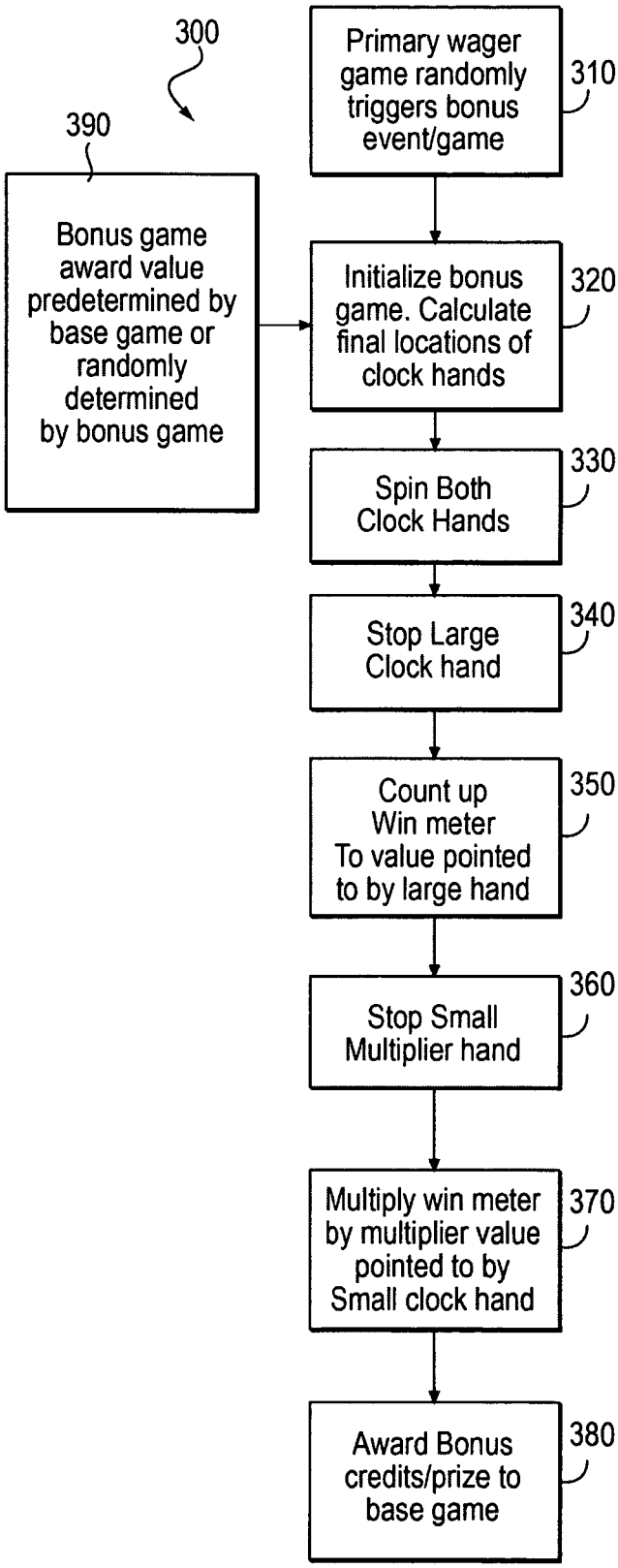
FIG. 3 illustrates an embodiment of a process of operating an embodiment of a clock hand bonus apparatus.

FIG. 3 illustrates an embodiment of a process of operating an embodiment of a clock hand bonus apparatus. Process 300 provides a process of operating the bonus game based on a two phase process. Process 300 includes receiving a signal to operate, initializing the game, spinning the two clock hands, stopping the first clock hand, counting up the value of the first clock hand indicia, stopping the second clock hand, counting up the value of the second clock hand indicia, and awarding the corresponding prize.

Process 300 and other processes of this document are implemented as a set of modules, which may be process modules or operations, software modules with associated functions or effects, hardware modules designed to fulfill the process operations, or some combination of the various types of modules, for example. The modules of process 300 and other processes described herein may be rearranged, such as in a parallel or serial fashion, and may be reordered, combined, or subdivided in various embodiments.

Process 300 initiates with receipt of a trigger signal at module 310 from an associated base game. At module 320, the game is initialized and a predetermination is made of the result of the game. This is informed by information from module 390 about whether the bonus gaming result should be predetermined by the base game or determined by the bonus game. Progressive value considerations may be accounted for at this point as well.

The player perceives action at module 330 when both hands start spinning. At module 340, the first clock hand stops at its predetermined stop point. Based on the associated indicia for the first clock hand, at module 350, a result is counted up. This process may be used to enhance excitement of the game for the player. At module 360, the second clock hand stops at its predetermined stop point. Based on the associated indicia for the second clock hand, at module 370, the result is counted again. This may be indicated by counting through a multiplier. For example, if the first indicia is 15 and the second indicia is 5, the counting process for module 350 may be a count from 0 to 15 and the counting process for module 370 may be a count of 15, 30, 45, 60 and 75. Other schemes may be employed to provide a visually interesting display, and audio may be integrated as well. As a final result of the bonus game, at module 380, a prize is awarded, based on the bonus gaming result (potentially in combination with a base gaming result).

Figure 4:
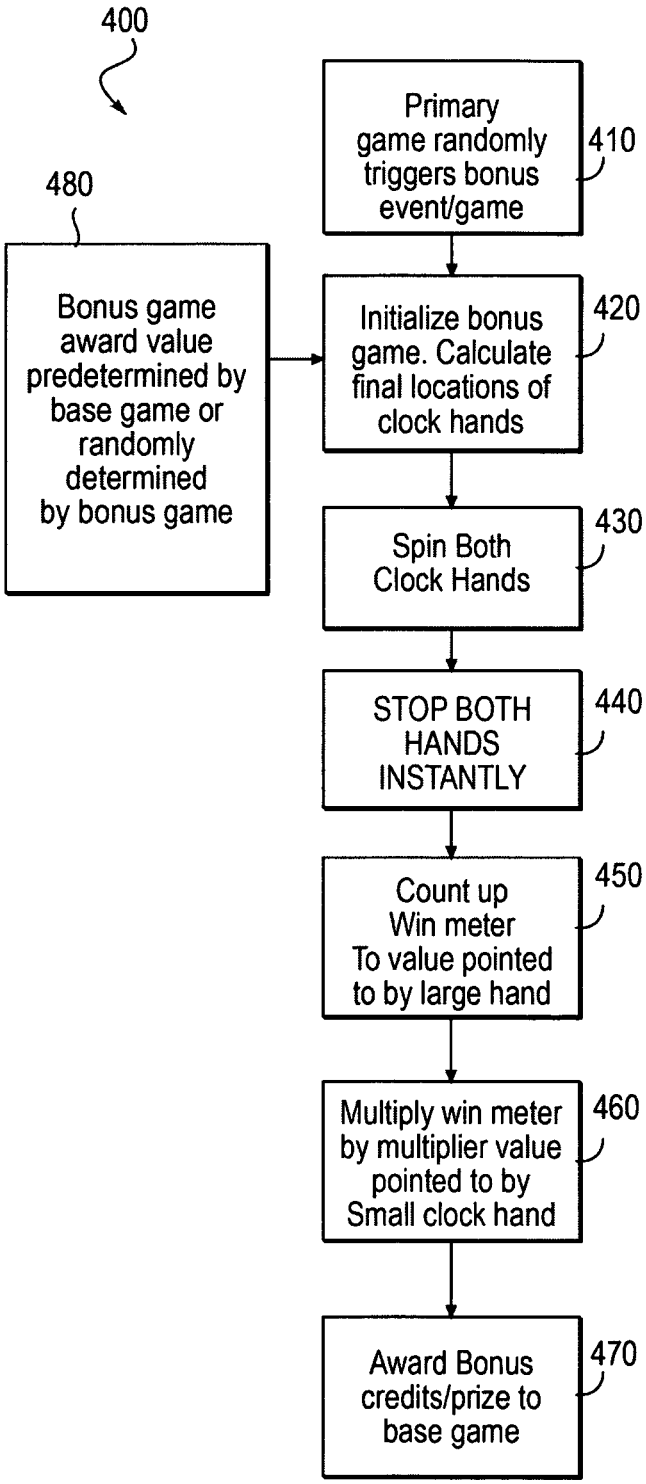
FIG. 4 illustrates another embodiment of a process of operating an embodiment of a clock hand bonus apparatus.

FIG. 4 illustrates another embodiment of a process of operating an embodiment of a clock hand bonus apparatus. Process 400 provides a process of operating the bonus game based on a single spin of both clock hands. Process 400 includes receiving a signal to operate, initializing the game, spinning the two clock hands, stopping both clock hands, counting up the value of the first clock hand indicia, counting up the value of the second clock hand indicia, and awarding the corresponding prize.

Process 400 initiates with receipt of a trigger signal at module 410 from an associated base game. At module 420, the game is initialized and a predetermination is made of the result of the game. Module 420 may be controlled in part by information from module 480 about whether the bonus gaming result should be predetermined by the base game or determined by the bonus game, and module 420 may account for progressive value considerations at this point as well.

The player perceives action at module 430 when both hands start spinning. At module 440, the two clock hands stop at predetermined stop points. Based on the associated indicia for the first clock hand, at module 450, a result is counted up. At module 460, based on the associated indicia for the second clock hand, the result is counted again. This may be indicated by counting through a multiplier, for example. Other schemes may be employed to provide a visually interesting display, and audio may be integrated as well. As a final result of the bonus game, a prize is awarded at module 470, based on the bonus gaming result (potentially in combination with a base gaming result).

In other embodiments, the first hand may spin while the other is at rest. Then the first hand stops spinning and count up occurs. Next the second hand spins and then comes to a rest. Multiplier effect (count up of the second hand indicia) is then done. Each phase of this may occur automatically or at the initiation of the player pressing a button or using the touchscreen on the gaming device, for example. Similarly, the processes 300 and 400 may be modified to allow more interaction with the player (e.g. counting up after the player presses a button or touchscreen, for example).

In some embodiments, the hands may spin in the same direction whereas in other embodiments the hands may spin in alternate directions. The clock hands may also change directions in subsequent spins in some embodiments. This may be accomplished through use of two different motors (e.g. stepper motors) or through appropriate gearing or other drive mechanisms well known to those of skill in the art. The motors are typically controlled by motor controllers, as is also well known to those of skill in the art. Similarly, in some embodiments, the player may initiate spin on the top (bonus) game by depressing the spin button on the base game control deck. The player may likewise initiate the stop sequence of the clock bonus game. The hands would then stop simultaneously or in sequence (one after the other).

A base game may give any number of spins of one or more clock hands of the bonus game (e.g. the first clock hand or both clock hands may be spun multiple times). The total value of all spins may be summed to a total prize value in some embodiments. The prize value to be awarded can also be determined by the base game winning combination achieved in some embodiments. A smaller winning combination (often more frequent in occurrence) on the base game may give a smaller total prize award on the clock bonus game. The clock bonus game would map the prize value to the hand positions and determine the final resting location of the spinning hands. This game may use an Instant Spin Feature such as that available from Bally. The spin button on the base game would randomly determine if this bonus game would occur or the base game would occur in consideration of the player's wager.

Alternately the clock hands may spin a random time and their final resting location determines the prize value in some embodiments. Similarly, the clock hands final resting location may be determined by a weighted probability table for each resting position in some embodiments. Each final location may have a different probability of stopping on it. One or two random numbers would be selected (one for each hand or one for both). The random number would determine the final resting location.

Figure 5:
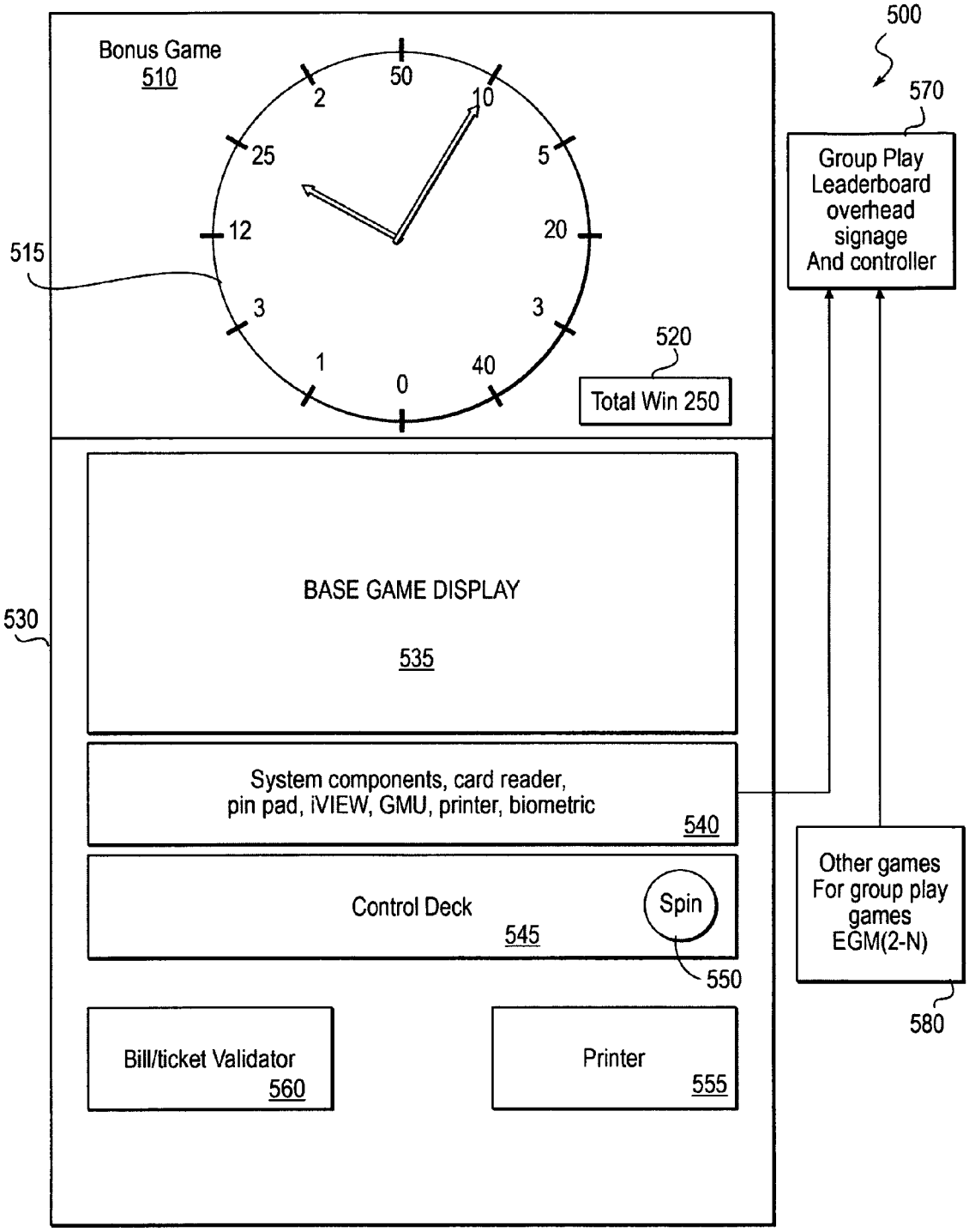
FIG. 5 illustrates an embodiment of a gaming apparatus including a clock hand bonus apparatus.

FIG. 5 illustrates an embodiment of a gaming apparatus including a clock hand bonus apparatus. System 500 includes a bonus game 510 and an associated base game 530. Bonus game 510 includes a face 515 and a win meter 520, and may be implemented in a manner similar to the embodiments of FIG. 1 or 2, for example.

Base game 530 may be a conventional gaming machine of either a game of skill or a game of chance. Base game 530 includes a base game display 535, system components 540, a control deck 545, a spin button 550, a bill/ticket validator 560 and a printer 555. The overall system may also include a leaderboard 570, and a set of additional base games 580. The leader board 570 may be expected to provide information about competitive or tournament play and may also include any progressive prize information in some embodiments. The additional base games may be expected to be the same as or similar to base game 530.

Returning to base game 530, the base game display 535 may display the base game action and results. The system components 540 may include basic processing components (such as a computer along the lines of that shown in FIG. 8), a card reader, a PIN pad, interfaces or components with gaming management functions, a printer interface, a biometric interface, and other components needed to operate the game 530. Control deck 545 may provide a user interface used to control the game action. In contrast, a card reader, PIN pad, or biometric interface may be used to validate identity information used in player tracking systems. Printer 555 may print out claim tickets or prize tickets (whether game-specific or generic). Bill/ticket validator 560 may validate cash or tickets used to provide value allowing a player to play the game.

Figure 6:
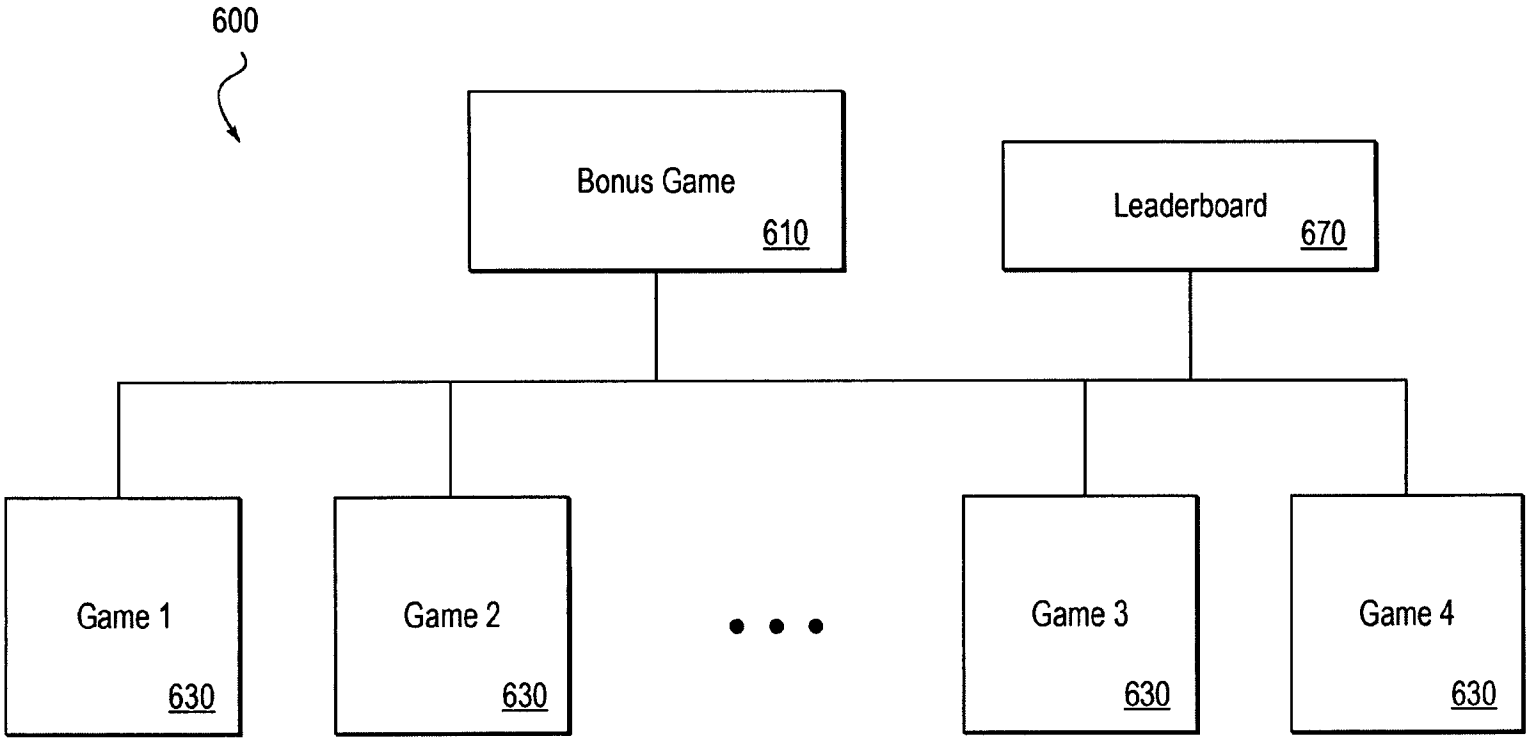
FIG. 6 illustrates an embodiment of a group of gaming apparatuses associated with a clock hand bonus apparatus.

FIG. 6 illustrates an embodiment of a group of gaming apparatuses associated with a clock hand bonus apparatus. System 600 includes bonus game 610, leaderboard 670 and a series of games 630. Bonus game 610 may be implemented as a bonus game such as that illustrated in FIG. 1 or 2, for example. Leaderboard 670 may be implemented as a display showing tournament or competitive gaming information and/or progressive value information. Games 630 may be free-standing games similar to base game 530 of FIG. 5, and one may expect that games 630 will be all of the same type. Thus, games 1 through 4 may be included, or games 1 through N may be used (the number of games need not be fixed over time). Bonus game 610 may have a progressive or communal quality, in that it may be triggered by one of the base games 630 at a given time, and it may either affect only the outcome of the triggering game 630, or the outcome of all of the games 630. Additionally, any progressive prize may be built up based on contributions from all of the games 630.

The clock hand game may be the scoring mechanic for a group play bonus game or round. One machine would trigger a group play bonus game by a random or predetermined event being triggered. The event need not be limited to a winning combination—a scatter symbol or other event may be used, for example. Other qualified base games in the same bank of base games or other banks would enter bonus time clock spin mode. In some embodiments, each base game would go into a free play mode so every "spin button" press would spin the free bonus time clock game and not the base game.

Each player would have X number of spins of both hands while in the group play competition. X may be a predetermined or a random number, and may differ for different players in some embodiments. The two hands would multiply together and add to the total win meter. After all of the clock hand spins are done the player's final score is compared to other players' scores achieved in the same way. The highest ranking player will get the highest prize or progressive.

In one embodiment, people who wager less on the primary game will be given fewer spins in the bonus time game while in group play competition. This results in less opportunity to get a higher score. However, if the player lands on great hand values then the resulting score could be the highest ranked in the group play bonus game. Overhead signage and each base game would show the leader list and prizes won. There would be a group play controller having the ranked leader board list in some embodiments.

This same type of multiple spin clock hand game can be shown on the iVIEW system available from Bally as a tournament. Winning players would win the tournament prize. In such systems, a bankrupt will reset total win meter for all spins while in bonus spin time. Also, note that this game could be a very top box bonus game with 2 video monitors below for the normal game and its marquee glass display (Effectively 3 presentation displays), for example.

Figure 7:
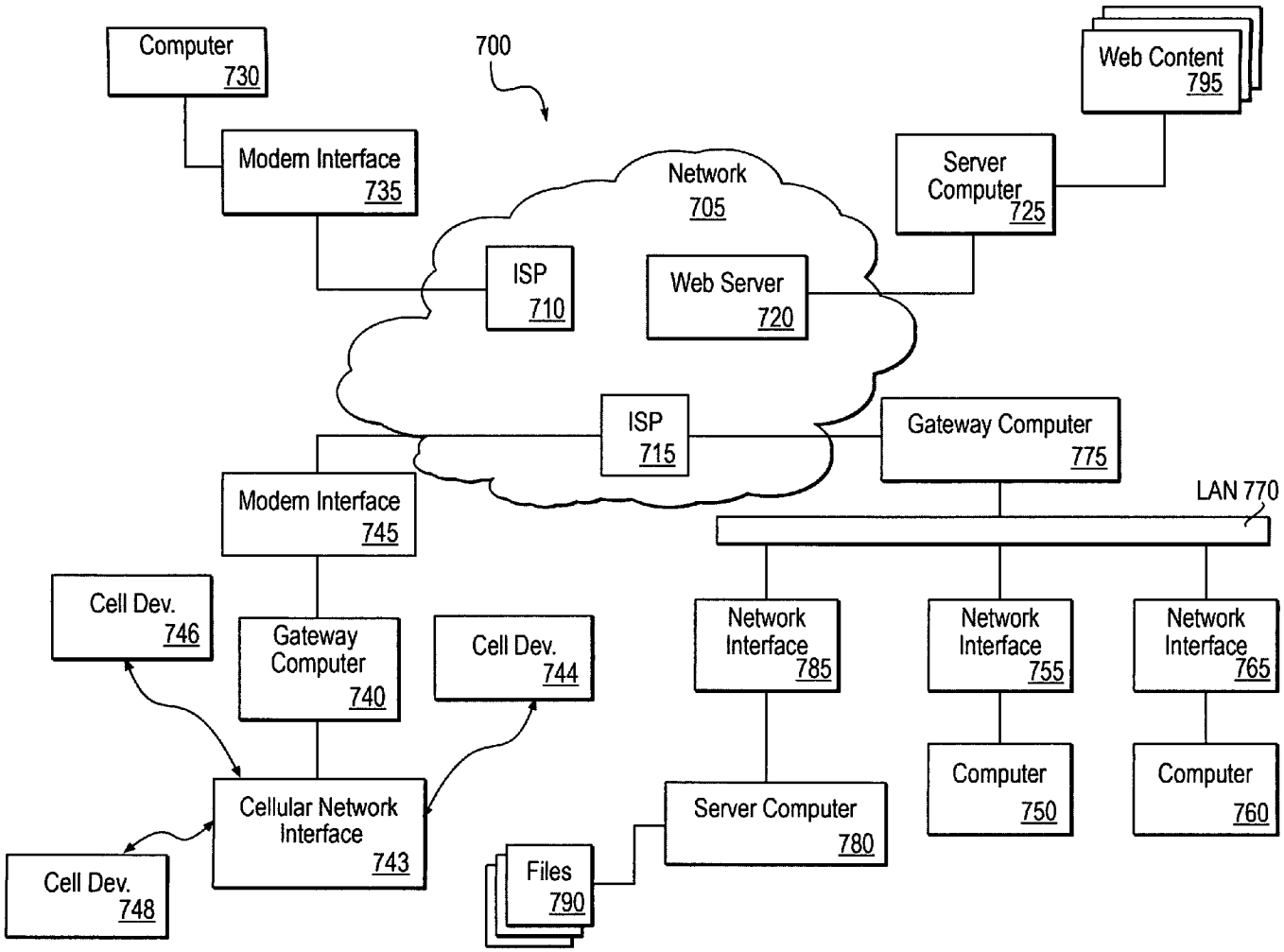
FIG. 7 illustrates an embodiment of a network which may be used in conjunction with a clock hand bonus apparatus.
Figure 8:
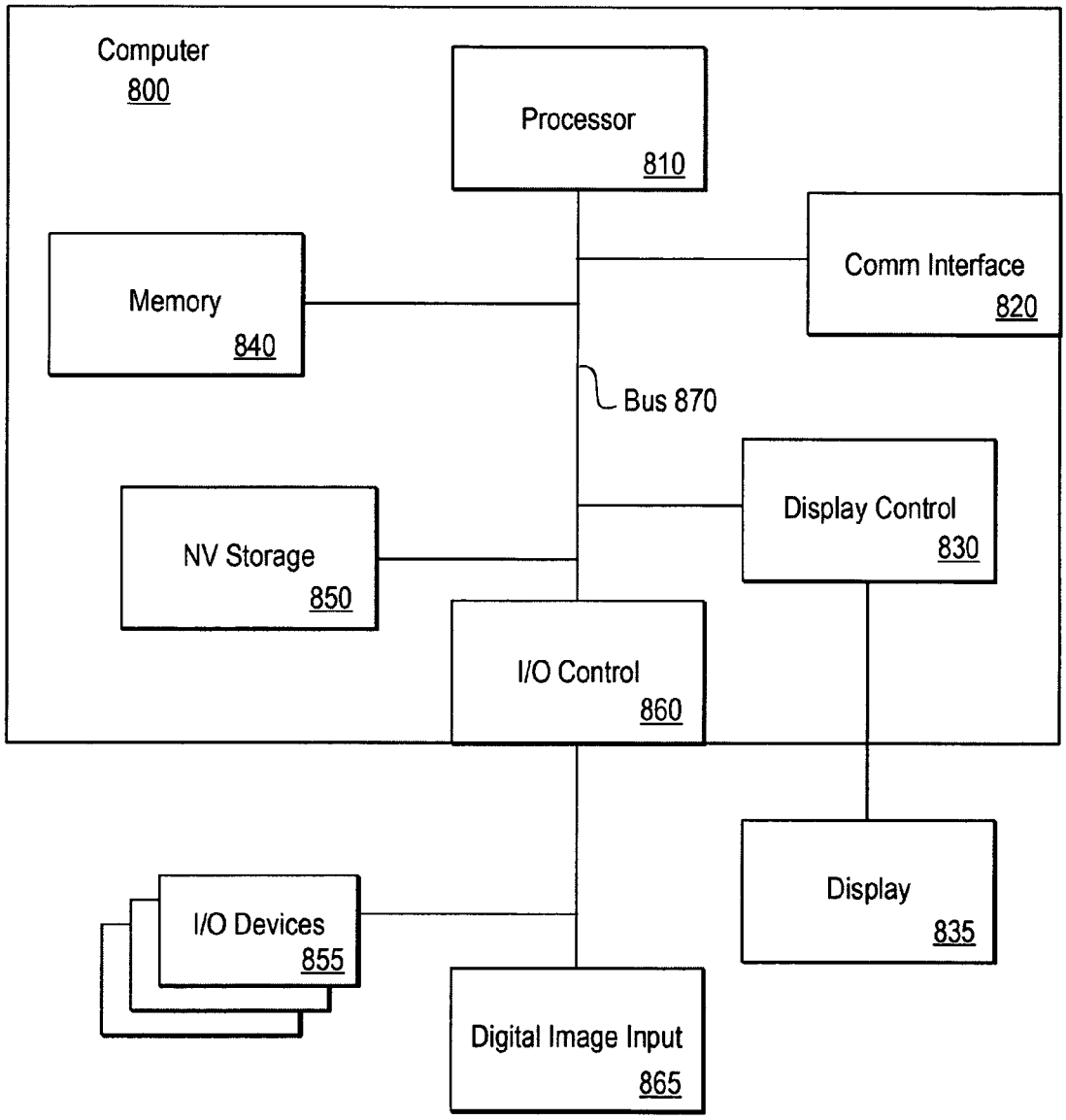
FIG. 8 illustrates an embodiment of a computer which may be used in conjunction with (or as part of) a clock hand bonus apparatus.

FIG. 7 illustrates an embodiment of a network which may be used in conjunction with a clock hand bonus apparatus. FIG. 8 illustrates an embodiment of a computer which may be used in conjunction with (or as part of) a clock hand bonus apparatus or an associated base game apparatus. The following description of FIGS. 7 and 8 is intended to provide an overview of device hardware and other operating components suitable for performing the methods of the invention described above and hereafter, but is not intended to limit the applicable environments.

Similarly, the hardware and other operating components may be suitable as part of the apparatuses described above. The invention can be practiced with other system configurations, including personal computers, multiprocessor systems, microprocessor-based or programmable consumer electronics, network PCs, minicomputers, mainframe computers, and the like. The invention can also be practiced in distributed computing environments where tasks are performed by remote processing devices that are linked through a communications network.

FIG. 7 shows several computer systems that are coupled together through a network 705, such as the internet, along with a cellular or other wireless network and related cellular or other wireless devices. The term "internet" as used herein refers to a network of networks which uses certain protocols, such as the TCP/IP protocol, and possibly other protocols such as the hypertext transfer protocol (HTTP) for hypertext markup language (HTML) documents that make up the world wide web (web). The physical connections of the internet and the protocols and communication procedures of the internet are well known to those of skill in the art.

Access to the internet 705 is typically provided by internet service providers (ISP), such as the ISPs 710 and 715. Users on client systems, such as client computer systems 730, 750, and 760 obtain access to the internet through the internet service providers, such as ISPs 710 and 715. Access to the internet allows users of the client computer systems to exchange information, receive and send e-mails, and view documents, such as documents which have been prepared in the HTML format. These documents are often provided by web servers, such as web server 720 which is considered to be "on" the internet. Often these web servers are provided by the ISPs, such as ISP 710, although a computer system can be set up and connected to the internet without that system also being an ISP.

The web server 720 is typically at least one computer system which operates as a server computer system and is configured to operate with the protocols of the world wide web and is coupled to the internet. Optionally, the web server 720 can be part of an ISP which provides access to the internet for client systems. The web server 720 is shown coupled to the server computer system 725 which itself is coupled to web content 795, which can be considered a form of a media database. While two computer systems 720 and 725 are shown in FIG. 7, the web server system 720 and the server computer system 725 can be one computer system having different software components providing the web server functionality and the server functionality provided by the server computer system 725 which will be described further below.

Cellular network interface 743 provides an interface between a cellular network and corresponding cellular devices 744, 746 and 748 on one side, and network 705 on the other side. Thus cellular devices 744, 746 and 748, which may be personal devices including cellular telephones, two-way pagers, personal digital assistants or other similar devices, may connect with network 705 and exchange information such as email, content, or HTTP-formatted data, for example.

Cellular network interface 743 is representative of wireless networking in general. In various embodiments, such an interface may also be implemented as a wireless interface such as a Bluetooth interface, IEEE 802.11 interface, or some other form of wireless network. Similarly, devices such as devices 744, 746 and 748 may be implemented to communicate via the Bluetooth or 802.11 protocols, for example. Other dedicated wireless networks may also be implemented in a similar fashion.

Cellular network interface 743 is coupled to computer 740, which communicates with network 705 through modem interface 745. Computer 740 may be a personal computer, server computer or the like, and serves as a gateway. Thus, computer 740 may be similar to client computers 750 and 760 or to gateway computer 775, for example. Software or content may then be uploaded or downloaded through the connection provided by interface 743, computer 740 and modem 745.

Client computer systems 730, 750, and 760 can each, with the appropriate web browsing software, view HTML pages provided by the web server 720. The ISP 710 provides internet connectivity to the client computer system 730 through the modem interface 735 which can be considered part of the client computer system 730. The client computer system can be a personal computer system, a network computer, a web tv system, or other such computer system.

Similarly, the ISP 715 provides internet connectivity for client systems 750 and 760, although as shown in FIG. 7, the connections are not the same as for more directly connected computer systems. Client computer systems 750 and 760 are part of a LAN coupled through a gateway computer 775. While FIG. 7 shows the interfaces 735 and 745 as generically as a "modem," each of these interfaces can be an analog modem, isdn modem, cable modem, satellite transmission interface (e.g. "direct PC"), or other interfaces for coupling a computer system to other computer systems.

Client computer systems 750 and 760 are coupled to a LAN 770 through network interfaces 755 and 765, which can be ethernet network or other network interfaces. The LAN 770 is also coupled to a gateway computer system 775 which can provide firewall and other internet related services for the local area network. This gateway computer system 775 is coupled to the ISP 715 to provide internet connectivity to the client computer systems 750 and 760. The gateway computer system 775 can be a conventional server computer system. Also, the web server system 720 can be a conventional server computer system. Alternatively, a server computer system 780 can be directly coupled to the LAN 770 through a network interface 785 to provide files 790 and other services to the clients 750, 760, without the need to connect to the internet through the gateway system 775.

FIG. 8 shows one example of a personal device that can be used as a cellular telephone (744, 746 or 748) or similar personal device, or may be used as a more conventional personal computer, as an embedded processor or local console, or as a PDA, for example. Such a device can be used to perform many functions depending on implementation, such as game playing, office software functions, internet access and communication functions, monitoring functions, user interface functions, telephone communications, two-way pager communications, personal organizing, or similar functions. The system 800 of FIG. 8 may also be used to implement other devices such as a personal computer, network computer, or other similar systems.

The computer system 800 interfaces to external systems through the communications interface 820. In a cellular telephone, this interface is typically a radio interface for communication with a cellular network, and may also include some form of cabled interface for use with an immediately available personal computer. In a two-way pager, the communications interface 820 is typically a radio interface for communication with a data transmission network, but may similarly include a cabled or cradled interface as well. In a personal digital assistant, communications interface 820 typically includes a cradled or cabled interface, and may also include some form of radio interface such as a Bluetooth or 802.11 interface, or a cellular radio interface for example. Conventional computer systems often use an Ethernet connection to a network or a modem connection to the Internet, for example.

The computer system 800 includes a processor 810, which can be a conventional microprocessor such as an Intel pentium microprocessor or Motorola power PC microprocessor, a Texas Instruments digital signal processor, or some combination of the various types or processors. Note that processor 810 and the other components can represent single or multiple components of the same type. Memory 840 is coupled to the processor 810 by a bus 870. Memory 840 can be dynamic random access memory (dram) and can also include static ram (sram), or may include FLASH EEPROM, too. The bus 870 couples the processor 810 to the memory 840, also to non-volatile storage 850, to display controller 830, and to the input/output (I/O) controller 860. Note that the display controller 830 and I/O controller 860 may be integrated together, and the display may also provide input.

The display controller 830 controls in the conventional manner a display on a display device 835 which typically is a liquid crystal display (LCD) or similar flat-panel, small form factor display. The input/output devices 855 can include a keyboard, or stylus and touch-screen, and may sometimes be extended to include disk drives, printers, a scanner, and other input and output devices, including a mouse or other pointing device. The display controller 830 and the I/O controller 860 can be implemented with conventional well known technology. A digital image input device 865 can be a digital camera which is coupled to an I/O controller 860 in order to allow images from the digital camera to be input into the device 800.

The non-volatile storage 850 is often a FLASH memory or read-only memory, or some combination of the two. A magnetic hard disk, an optical disk, or another form of storage for large amounts of data may also be used in some embodiments, though the form factors for such devices typically preclude installation as a permanent component of the device 800. Rather, a mass storage device on another computer is typically used in conjunction with the more limited storage of the device 800. Some of this data is often written, by a direct memory access process, into memory 840 during execution of software in the device 800. One of skill in the art will immediately recognize that the terms "machine-readable medium" or "computer-readable medium" includes any type of storage device that is accessible by the processor 810 and also encompasses a carrier wave that encodes a data signal.

The device 800 is one example of many possible devices which have different architectures. For example, devices based on an Intel microprocessor often have multiple buses, one of which can be an input/output (I/O) bus for the peripherals and one that directly connects the processor 810 and the memory 840 (often referred to as a memory bus). The buses are connected together through bridge components that perform any necessary translation due to differing bus protocols.

In addition, the device 800 is controlled by operating system software which includes a file management system, such as a disk operating system, which is part of the operating system software. One example of an operating system software with its associated file management system software is the family of operating systems known as Windows CE® and Windows® from Microsoft Corporation of Redmond, Wash., and their associated file management systems. Another example of an operating system software with its associated file management system software is the Palm® operating system and its associated file management system. The file management system is typically stored in the non-volatile storage 850 and causes the processor 810 to execute the various acts required by the operating system to input and output data and to store data in memory, including storing files on the non-volatile storage 850. Other operating systems may be provided by makers of devices, and those operating systems typically will have device-specific features which are not part of similar operating systems on similar devices. Similarly, WinCE® or Palm® operating systems may be adapted to specific devices for specific device capabilities.

Device 800 may be integrated onto a single chip or set of chips in some embodiments, and typically is fitted into a small form factor for use as a personal device. Thus, it is not uncommon for a processor, bus, onboard memory, and display/I-O controllers to all be integrated onto a single chip. Alternatively, functions may be split into several chips with point-to-point interconnection, causing the bus to be logically apparent but not physically obvious from inspection of either the actual device or related schematics. It should also be noted that while several exemplary embodiments for the clock are mechanical embodiments, other embodiments may differ in structure, e.g. a video screen controlled by a video controller to display an image of a clock.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention, in some embodiments, also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language, and various embodiments may thus be implemented using a variety of programming languages.

One skilled in the art will appreciate that although specific examples and embodiments of the system and methods have been described for purposes of illustration, various modifications can be made without deviating from present invention. For example, embodiments of the present invention may be applied to many different types of databases, systems and application programs. Moreover, features of one embodiment may be incorporated into other embodiments, even where those features are not described together in a single embodiment within the present document.

The invention claimed is:

1. A gaming apparatus, comprising:

a first clock hand;

a second clock hand;

a face, the face having a generally planar surface and an axis of rotation, the face having indicia arranged in a generally circular pattern around the axis of rotation on a first surface of the face, the first clock hand arranged to rotate around the axis of rotation above the first surface of the face and the second clock hand arranged to rotate around the axis of rotation above the first surface of the face;

an interface, the interface to couple to a base game apparatus, the base game apparatus to send a signal;

a controller, the controller coupled to the first clock hand and the second clock hand and to the interface, the controller to rotate the first clock hand and the second clock hand responsive to receipt of the signal of the base game apparatus, the controller to operate the first clock hand and the second clock hand in relation to the signal received through the interface, the controller to spin the first clock hand and the second clock hand one or multiple times with one or multiple results, respectively, the controller to accumulate the multiple results, to produce the bonus result; and wherein the gaming apparatus is to produce the bonus result based on indicia of the face in relation to the first clock hand and the second clock hand;

wherein the indicia comprise indicia for a progressive prize and the progressive prize is awarded when the first clock hand and the second clock hand both point to indicia for the progressive prize when rotation of the first clock hand and the second clock hand stops after a spin; and wherein the indicia for the progressive prize further comprises associated different indicia to produce the bonus result when only one of the first clock hand and the second clock hand points to the indicia for the progressive prize when rotation of the first clock hand and the second clock hand stops after a spin.

2. The gaming apparatus of claim 1, wherein:

the controller includes a first stepper motor coupled to the first clock hand and a second stepper motor coupled to the second clock hand.

3. The gaming apparatus of claim 1, wherein:

the controller moves the first clock hand independently from the second clock hand.

4. The gaming apparatus of claim 1, wherein:

the controller includes a gearing mechanism coupled to the first clock hand and coupled to the second clock hand, the gearing mechanism to move the first clock hand and the second clock hand in coordination.

5. The gaming apparatus of claim 1, wherein:

the interface couples to a single base game apparatus.

6. The gaming apparatus of claim 5, wherein:

the base game apparatus is physically connected to the gaming apparatus.

7. The gaming apparatus of claim 1, wherein:

the interface couples to a plurality of base game apparatuses.

8. The gaming apparatus of claim 7, wherein:

the plurality of base game apparatuses and the gaming apparatus are coordinated by a separate control apparatus, and wherein the control apparatus is coupled to the gaming apparatus and to each base game apparatus of the plurality of base game apparatuses.

9. The gaming apparatus of claim 7, wherein:

the base game apparatuses of the plurality of base game apparatuses and the gaming apparatus are each coupled to a leaderboard.

10. The gaming apparatus of claim 7, wherein the gaming apparatus is configured to activate responsive to an event at a base game apparatus of the plurality of base game apparatuses selected from the following group: a wager, a win, a win exceeding a predetermined threshold, and a series of wins.

11. The gaming apparatus of claim 1, wherein:

the first surface of the face has a single set of indicia arranged in a single generally circular pattern.

12. The gaming apparatus of claim 1, wherein:

the indicia of the first surface of the face include a first set of indicia arranged in an outer circle having a generally circular pattern, the first clock hand arranged to point to indicia of the first set of indicia, and the indicia of the first surface of the face include a second set of indicia arranged in an inner circle having a generally circular pattern, the second clock hand arranged to point to indicia of the second set of indicia.

13. The gaming apparatus of claim 1, further comprising:

a progressive total display.

14. The gaming apparatus of claim 1, further comprising:

a winning result display.

15. The gaming apparatus of claim 1, wherein the indicia comprise indicia for a bankrupt or zero prize and the bonus result is reduced to zero when one of the first clock hand and the second clock hand points to indicia for the bankrupt or zero prize when rotation of the first clock hand and the second clock hand stops after a spin.

16. A gaming apparatus, comprising:

a first clock hand;

a second clock hand;

a face, the face having a generally planar surface and an axis of rotation, the face having indicia arranged in a generally circular pattern around the axis of rotation on a first surface of the face, the first clock hand arranged to rotate around the axis of rotation above the first surface of the face and the second clock hand arranged to rotate around the axis of rotation above the first surface of the face, the indicia of the first surface of the face include a first set of indicia arranged in an outer circle having a generally circular pattern, the first clock hand arranged to point to indicia of the first set of indicia, and the indicia of the first surface of the face include a second set of indicia arranged in an inner circle having a generally circular pattern, the second clock hand arranged to point to indicia of the second set of indicia;

an interface, the interface to couple to a base game apparatus, the base game apparatus to send a signal;

a controller, the controller coupled to the first clock hand and the second clock hand and to the interface, the controller to rotate the first clock hand and the second clock hand responsive to receipt of the signal of the base game apparatus, the controller to operate the first clock hand and the second clock hand in relation to the signal received through the interface, the controller to spin the first clock hand and the second clock hand one or multiple times with one or multiple results, respectively, the controller to accumulate the multiple results, to produce a bonus result;

a result display coupled to the controller to receive and display the bonus gaming result from the controller; and wherein the gaming apparatus is to produce the bonus result based on the first and second indicia of the face in relation to the first clock hand and the second clock hand; and wherein the indicia comprise indicia for a progressive prize and the progressive prize is awarded when the first clock hand points to progressive prize indicia comprising the first set of indicia and the second clock hand points to progressive prize indicia comprising the second set of indicia when rotation of the first clock hand and the second clock hand stops after a spin.

17. The gaming apparatus of claim 16, wherein:

the controller includes a first stepper motor coupled to the first clock hand and a second stepper motor coupled to the second clock hand.

18. The gaming apparatus of claim 16, wherein:

the controller includes a gearing mechanism coupled to the first clock hand and coupled to the second clock hand, the gearing mechanism to move the first clock hand and the second clock hand in coordination.

19. The gaming apparatus of claim 16, wherein:

a base game apparatus is physically connected to the gaming apparatus and the interface couples to the base game apparatus.

20. The gaming apparatus of claim 16, wherein the gaming apparatus is configured to activate responsive to an event at a base game apparatus selected from the following group: a wager, a win, a win exceeding a predetermined threshold, and a series of wins.

* * * * *